United States Patent [19]

Cameron et al.

[11] Patent Number: 4,797,003

[45] Date of Patent: Jan. 10, 1989

[54] FOAMED SLURRY GENERATOR

[75] Inventors: Donald C. Cameron, Tulsa, Okla.; Mat Hoover, Midland, Tex.

[73] Assignee: Dowell Schlumberger Incorporated, Tulsa, Okla.

[21] Appl. No.: 41,553

[22] Filed: Apr. 22, 1987

[51] Int. Cl.[4] ..... B01F 13/02

[52] U.S. Cl. ..... 366/101; 366/177; 366/341

[58] Field of Search ..... 366/340, 336, 3, 5, 366/10, 11, 101, 177, 341; 406/45, 181, 108, 117, 26; 137/68.1; 261/122

[56] References Cited

U.S. PATENT DOCUMENTS

| | | | |
|---|---|---|---|
| 759,731 | 5/1904 | Miles | 261/122 |
| 2,800,912 | 2/1957 | McCamish et al. | 137/68.1 |
| 3,232,590 | 2/1966 | Eckert | 366/336 |
| 3,410,344 | 11/1968 | Cornelius . | |
| 3,593,800 | 7/1971 | Hutchison . | |
| 3,603,398 | 9/1971 | Hutchison . | |
| 3,685,807 | 8/1972 | Campbell | 366/3 |
| 3,926,257 | 12/1975 | Marrast et al. . | |
| 4,114,653 | 9/1978 | Carlin | 137/68.1 |
| 4,300,633 | 11/1981 | Stewart . | |
| 4,415,366 | 11/1983 | Copening . | |
| 4,457,375 | 7/1984 | Cummins . | |
| 4,466,833 | 8/1984 | Spangle . | |
| 4,470,727 | 9/1984 | Ritter . | |
| 4,544,207 | 10/1985 | Litz | 366/340 |
| 4,647,212 | 3/1987 | Hankison | 366/340 |

*Primary Examiner*—Harvey C. Hornsby
*Assistant Examiner*—J. Dwight Poffenberger
*Attorney, Agent, or Firm*—Stephen A. Littlefield

[57] ABSTRACT

A high pressure foam slurry generator, including a source of slurry, a source of gas, and a means for combining the slurry and the gas, which is usually nitrogen. A housing receiving the slurry and the gas has a connector with multiple channels. One channel for the nitrogen gas acts as an inlet and has a bushing with a series of multiple holes through which the nitrogen gas is broken into a plurality of high velocity streams. The slurry with a foamer agent added combines at right angles with the nitrogen gas and is formed before being pumped through a tubing string into a gas or oil well. Also included herein is a process for making foamed slurry by pumping a slurry capable of being foamed to a housing, pumping nitrogen to the same housing, separating the nitrogen into a plurality of high velocity streams, and combining the streams and the slurry in a foaming action. Either the slurry or the nitrogen may have two separate streams entering the housing as right angles to each other. All of the streams are normally combined at right angles to obtain the proper amount of foaming action.

9 Claims, 3 Drawing Sheets

FOAMED SLURRY GENERATOR

BACKGROUND OF THE INVENTION

This invention relates to an apparatus and method for producing foamed cement slurry as used in oil and gas wells. As generally illustrated in U.S. Pat. Nos. 4,457,375; 4,466,833; 3,685,807; and 4,415,366, cement slurries are very useful in drilling operations which include completion, maintenance, and service functions, such as cleaning out sand.

The foam apparatus and method of the prior art has had some deficiencies. As shown in the above patents, the foam generators are relatively complex and do not produce the light density of foam that is sometimes desired. When servicing a well, slurries of different weights are often necessary. A relatively light sand and water slurry under very high pressure is used in fracturing the well. A very heavy cement slurry may be pumped into the well to displace thick mud after the drilling. The heavy cement is then forced up the sides of the well to form a casing. Heavy slurries are by their nature difficult to pump and, as a result, casings often have to be formed in stages. The stage process is relatively slow and inefficient. When heavy cement slurries are not required by the nature of the well, "foamed" cement slurries, i.e., a gas combined with cement, may be used to displace the liquids in the well and to form the casing. If the slurry is light enough, the casing may be formed by foamed cement in one step.

Care must be taken in the formation of foamed cement slurry to ensure that the slurry itself and the resulting hardened casing are stable. If bubbles that are too big are combined with the slurry, they may rise to the top and thereby defeat the purpose of foaming. If the bubbles of gas are not uniformly distributed, they may combine with each other and cause weakened areas in the concrete casing.

This invention includes an apparatus and process for uniformly dispersing gas through a slurry to provide a very light, stable liquid. This liquid may be readily pumped into a well to displace the liquid therein and subsequently formed into a casing. The process of forming the casing may usually be done in one step.

The present invention has been able to utilize a relatively simple design in producing a very light, stable foam. In particular, a bushing having a number of channels or holes therein separates a stream of gas into a plurality of smaller diameter, higher velocity streams, and achieves a much greater foaming action. Moreover, the use of a particular type of connector which utilizes a twin flow of cement slurry or a twin flow of gas in a mixing chamber also adds to the ability to foam the cement while it is maintained in a stable configuration.

By utilizing this apparatus, a 0.9 ppg has been attained in a stable foam cement slurry. This is a lower density than any practical application that the applicant is aware has ever been achieved. The cement used in the slurry may include additives which are well known in the art. These additives aid in two different degrees in stability, adhesion, foaming action, weight, density, etc. In one actual test, 705 barrels Class C, 0.1 gallon/SK foam stabilizer, 1.5% at 52.1 pumped at 12 barrels per minute, was utilized. Nitrogen was added at a ratio of 100 scf/barrel of slurry throughout the foam stage; therefore, the nitrogen rate was 1200 scfm. As a result, stable foam cement was circulated to the surface and remained stable.

This invention also includes the process of producing foamed cement slurry by separating a stream of gas into a plurality of high pressure streams, combining it with a plurality of streams of cement slurry at an angle thereto, and subsequently pumping the resulting foamed cement slurry into a well. Alternately, a plurality of nitrogen gas sources may be combined with water and sand in the fracturing process. As used herein, slurry may include cement and/or sand and water.

SUMMARY OF THE INVENTION

This invention relates to a high pressure foam slurry generator which may be cement or sand and water comprising a source of liquid, a source of gas, and means for combining the liquid and the gas in a manner to form small bubbles of gas in the liquid, the means for combining including a housing and a multichannel connector having a mixing area. One channel of the connector is the inlet for the gas, usually nitrogen, which is separated into a plurality of smaller streams of higher velocity. At least one other channel of the inlet acts as an input for the cement slurry. The slurry and the gas, usually nitrogen, are thoroughly mixed in a chamber and transported out of the outlet channel. A third inlet channel may be used for the cement slurry or nitrogen gas for different treatments of the well. This invention further includes the process of making a foam cement, including pumping a cement slurry capable of being foamed to a housing, pumping a gas to the housing, separating the gas into a plurality of high velocity streams, and combining the streams and the slurry to cause a foaming action. The invention further includes pumping the foamed slurry into a well.

This invention further includes the process of fracturing a well using two streams of nitrogen which combine with sand and water at high pressures and velocity.

DETAILED DESCRIPTION OF THE DRAWINGS

Figure 1:
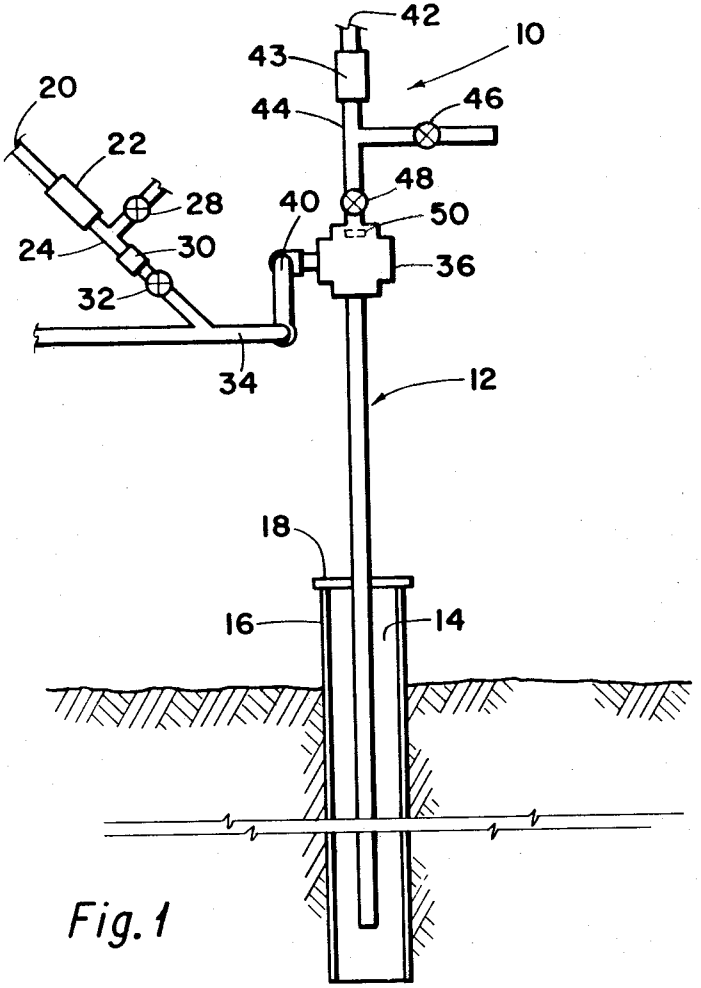
FIG. 1 is a schematic representation of an apparatus for pumping foamed cement slurry into a well.
Figure 4:
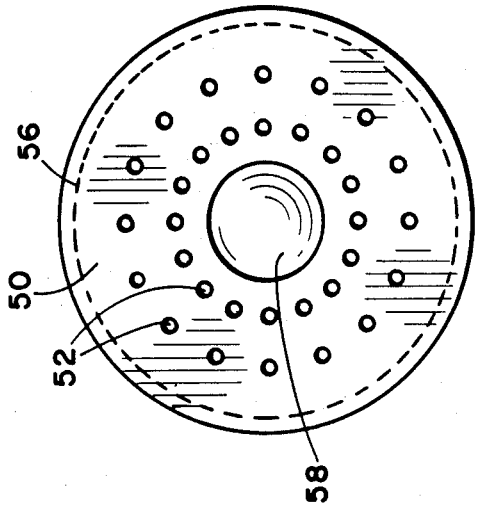
FIG. 4 is an end view of the bushing.

FIG. 1 is a schematic embodiment of the foam generator of the present invention, as utilized in a drilled well. It includes the foam generator 10, tubing string 12 leading into a well 14 having a casing 16 with a plate 18 at the top thereof. The foam generator 10 includes an inlet 20 for a high pressure cement slurry passing through a check valve 22 of any commercially available type to a T-fitting 24. A valve 28 is used to control the various additives to the cement slurry as it passes therethrough. The various additives may be any one of a number of commercially available types for controlling the foaming, amount, density, set-up time, weight, etc. A choke 30 is utilized to control the pressure and velocity of the cement slurry to a desirable level, typically four to five barrels per minute at 1000 psi. The choke 30 may be any one of a number of types commercially available and known in the art. A valve 32 controls the volume of the cement slurry to conduit 34, which is operatively attached to a housing 36 by means of connectors 40.

Also leading to the housing 36 is an inlet 42 which is supplied with high pressure gas, such as nitrogen or other gas well known in the art. Such other gases may be carbon dioxide, halogen, freon, etc. The gas is normally under high pressure either from a compressed source or after passing through a compressor (not shown). A check valve 43 ensures that there is no gas flowing back through the conduit 44. A valve 46 controls the input of a foamer or other additive to the gas. A valve 48 controls the input of the treated gas to the housing 36. Typically, the gas is nitrogen and enters at about 3000 psi at an equivalent of about 13–20 barrels/-min., with 15–16 equivalent barrels/min. preferred. The above parameters apply when the housing has about a 2½ inch internal diameter. Other pressures, velocities, and diameters will be obvious to one skilled in the art.

A foam generator bushing 50 (FIGS. 1 and 2) separates the source of high pressure nitrogen into a plurality of smaller, high velocity streams. The bushing 50 has a series of channels or holes 52 and a burst disc 58 along its longitudinal axis. The bushing is generally cylindrical in shape, having circular sealing recesses 56 therein. Other shapes will be obvious to one skilled in the art. The bushing 50 is so sized that it will fit into a recess 60 of a connector 62 having a plurality of channels. Inlet channel 64 has female threads therein and an internal diameter slightly larger than that for the recess 60 receiving the insert 50.

Figure 2:
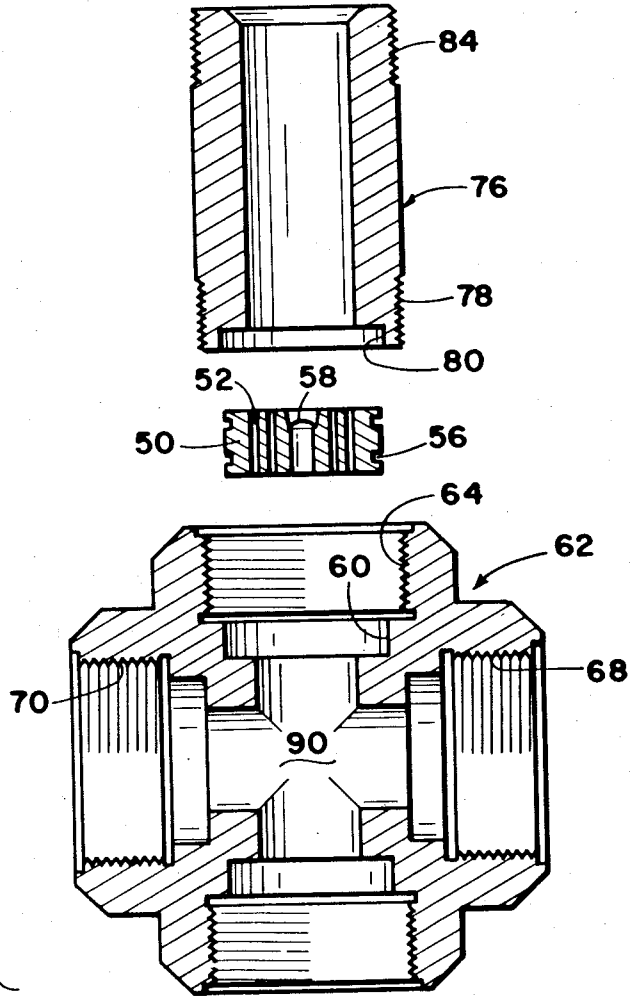
FIG. 2 is a cross section of the connector, foam generator bushing, and adapter of the invention.
Figure 3:
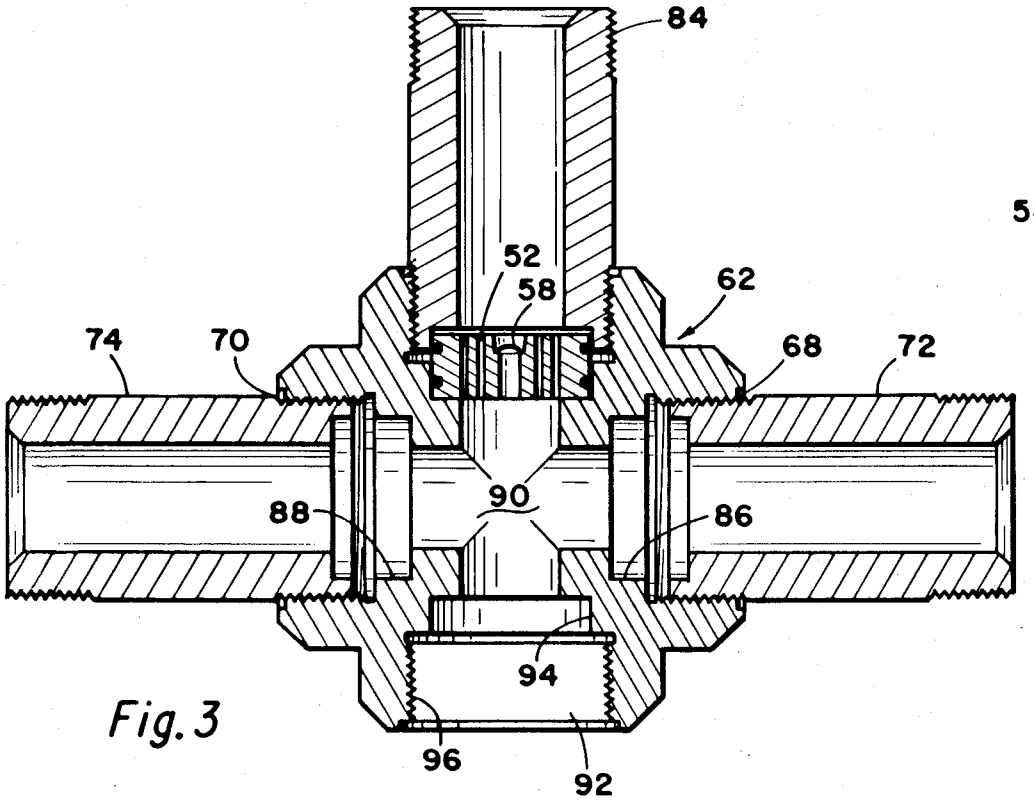
FIG. 3 is a cross-sectional view of the connector of this invention for forming foamed cement slurry.

As illustrated in FIGS. 2 and 3, inlets 68 and 70 may be utilized along with conduits 72 and 74, respectively, which are threadedly engaged therewith to provide inlets for the high pressure cement slurry. An adapter 76, having male threads 78 and a recess 80 properly sized to engage the insert 50, acts to hold the insert in place, as illustrated in FIG. 3. The insert also has male threads 84 at the other end thereof so it may be connected to another conduit. Channels 52 in the insert act to break up the stream of high pressure nitrogen into a plurality of many high velocity streams. The number of streams may vary anywhere from preferably 5 to 25; however, it has been found that the use of 16 channels is particularly advantageous. Different diameters may be utilized; however, 3/32 inch and 3/64 inch have also been found to be preferred in the above-described example.

The burst disc 58 is located near the center of the insert, but may be provided in other locations. It has an upwardly facing, convex surface, and may be any one of a number of commercially available burst discs. Burst disc pressure is set well above the operating pressure of the system. Typical of such burst pressures are 10,000 to 12,000 psi. Other safety devices above ground level may also be utilized in different parts of the system.

Important to this system is the maintenance of the foaming action even if the holes 52 should become clogged. If the burst disc 58 ruptures because of clogging in the holes 52, the nitrogen gas will continue to be fed into the connector 62 so that the process of mixing foamed, high pressure cement slurry will continue, albeit not as efficiently.

Similar recesses in the connector 62 are cement slurry recess inlets 86 and 88. All of the inlet recesses lead to a mixing chamber 90, where the gas and cement slurry or other liquid are mixed. In this particular embodiment, the cross connector has about a 2½-inch or 2⅞-inch bore. When using a 2½-inch bore connector and 16-3/64 inch holes, there is about an 8,000 psi working pressure. In this case, the typical burst pressure of the disc would be 10,000 psi. If the working pressure were 12,000 psi, the burst pressure of the disc would be about 15,000 psi.

It is important to note that an alternate embodiment of this invention includes a plurality of bushings 50, i.e., two of them at 90 degrees, i.e., on both sides, from an incoming slurry of sand and water. In this case, the water and sand would typically be at 2,000 to 12,000 psi at a rate of 5–20 barrels per minute, and the nitrogen would be 2,000 psi above the sand and water and have an equivalent input of about 5 barrels per minute of nitrogen. Both the utilization of two nitrogen gas inputs to a single flow of cement slurry and the use of a single nitrogen stream into two sand and water slurries have been found to produce substantially better results than those previously attained through one of each of the above. In actual tests, the density of foamed cement has been found to be as low as 0.9 ppg with the use of two nitrogen inputs on either side of a cement slurry stream.

In FIG. 3, an outlet 92 includes a recess 94 and female threads 96 in an area of increased diameter for connecting it to a well string.

Figure 5:
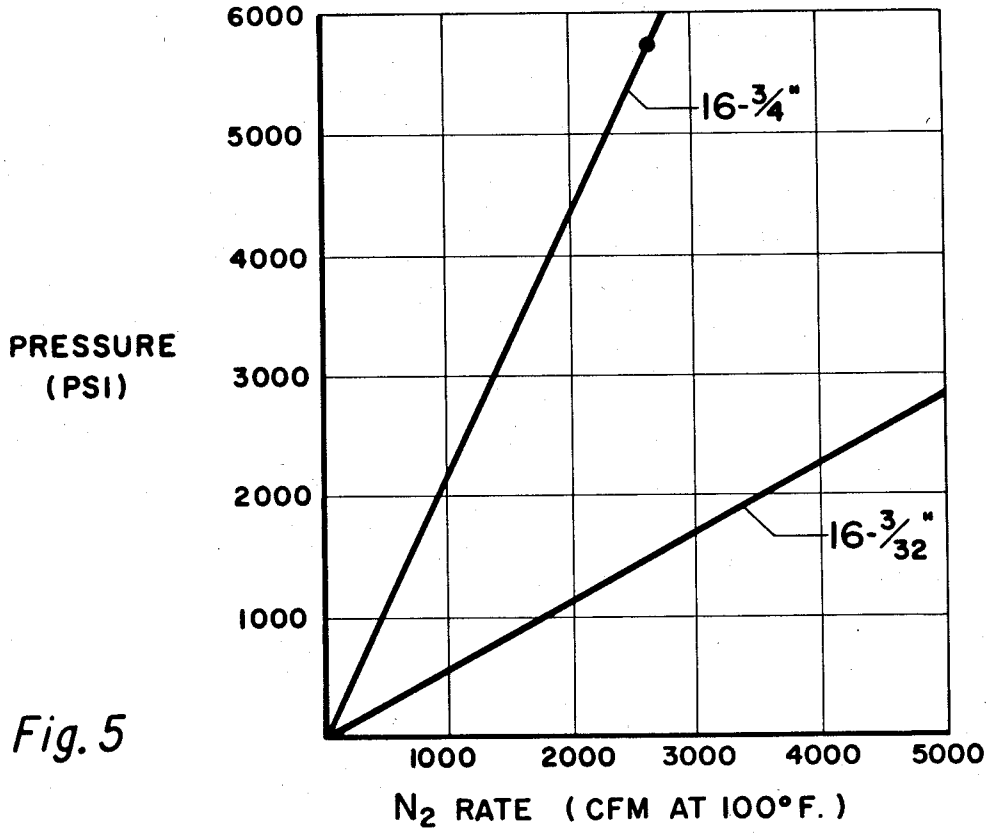
FIG. 5 is a graphical representation of the pressure versus the flow rates of the gas involved.

FIG. 5 illustrates a graph of the nitrogen rate of flow at 100° F. versus the pressure in the system. It can be seen that there is a straight-line relationship between the pressure and the nitrogen flow rate for the use of 16 channels at ¾-inch diameter and 16 holes for 3/32-inch diameter. Thus, for example, at about 6000 working psi using 16¾ inch holes, there would be a rate of flow of nitrogen of about 2500 cubic feet per minute. Other relationships can be seen from the graph.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. A high pressure foamed slurry generator operatively connected to a tubing string which pumps the slurry into a well, comprising:

a source of liquid;

a source of gas;

means for combining the liquid and the gas in a manner to form small bubbles of gas substantially uniformly in the liquid;

the means for combining including a housing and a multi-channel connector having a mixing area operatively attached to inlets and an outlet in the housing;

one channel of the connector being the inlet for the gas, at least one channel being the inlet for the slurry, and one channel being the outlet for the foamed slurry;

the inlet channel having a means for changing the gas into a plurality of smaller diameter, higher velocity streams of gas which are combined with the slurry in the mixing area and transported out of the outlet channel, wherein the means for changing the gas into a plurality of smaller streams includes a bushing operatively connected to the gas inlet channel, the bushing having a plurality of substantially parallel holes through which the gas passes into the slurry, thereby providing a foamed slurry.

2. The high pressure slurry generator of claim 1, wherein a burst disc is operatively connected in the housing to relieve pressure and the smaller streams are at substantially right angles to the inlet for the slurry.

3. The high pressure slurry generator of claim 1, wherein the bushing has a gas passageway connecting between the gas source and said gas inlet a burst disc mounted in said passageway to normally block flow therethrough which disc bursts if the holes should become clogged and the pressure exceeds a certain limit whereby the mixing of the slurry and gas continues even if the holes become clogged.

4. The high pressure slurry generator of claim 2, wherein there are 16 holes having a diameter of ¾-inch and the inlet bore has about a 2½-inch diameter.

5. The high pressure slurry generator of claim 2, wherein there are 16 holes having a diameter of 3/32-inch and the inlet bore has a 2β-inch bore.

6. The high pressure foamed slurry generator of claim 1, wherein the bushing has to slurry inlets at right angles to the gas inlet channel.

7. The high pressure foamed slurry generator of claim 1, wherein the housing has two gas inlet channels each having a bushing with a plurality of holes through which the gas passes at right angles to the inlet for the slurry.

8. The high pressure foamed slurry generator of claim 2, wherein the bushing fits in a channel of the connector and is held in position by an adapter which operatively engages the same channel.

9. The high pressure foamed slurry generator of claim 2, wherein the source of gas is nitrogen and includes a valve and check valve to control the passage of nitrogen.

* * * * *